US008698862B2

(12) United States Patent
Sugimura

(10) Patent No.: US 8,698,862 B2
(45) Date of Patent: Apr. 15, 2014

(54) PRINTER AND NON-TRANSITORY COMPUTER-READABLE MEDIUM

(71) Applicant: Yoshihiko Sugimura, Nagoya (JP)

(72) Inventor: Yoshihiko Sugimura, Nagoya (JP)

(73) Assignee: Brother Kogyo Kabushiki Kaisha, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 13/625,424

(22) Filed: Sep. 24, 2012

(65) Prior Publication Data

US 2013/0147894 A1 Jun. 13, 2013

(30) Foreign Application Priority Data

Dec. 9, 2011 (JP) ..... 2011-270238

(51) Int. Cl.
*B41J 11/00* (2006.01)

(52) U.S. Cl.
USPC ..... 347/218

(58) Field of Classification Search
USPC ..... 347/218
See application file for complete search history.

(56) References Cited

U.S. PATENT DOCUMENTS

| | | | | |
|---|---|---|---|---|
| 7,034,855 | B2 | 4/2006 | Muto et al. | |
| 8,035,672 | B2 | 10/2011 | Matsuda | |
| 2005/0219345 | A1* | 10/2005 | Muto et al. | 347/180 |

FOREIGN PATENT DOCUMENTS

| | | | |
|---|---|---|---|
| JP | 5-261959 | A | 10/1993 |
| JP | 8-011341 | A | 1/1996 |
| JP | 2001-180027 | A | 7/2001 |
| JP | 2005-186509 | A | 7/2005 |
| JP | 2005-280221 | A | 10/2005 |
| JP | 2009-297998 | A | 12/2009 |

* cited by examiner

*Primary Examiner* — Matthew Luu
*Assistant Examiner* — Alexander D Shenderov
(74) *Attorney, Agent, or Firm* — McCarter & English, LLP

(57) ABSTRACT

A printer includes a feeding portion, a printing portion and a processor. The feeding portion is configured to feed a printing medium in an auxiliary scanning direction. The printing portion includes a plurality of heating elements arrayed in a main scanning direction and configured to perform printing of one line at a time on the printing medium. The processor is configured to set, based on a first speed, a number of lines for each of which a number of ON dots is specified, specify numbers of ON dots for the set number of lines, set a second speed based on a maximum value among the specified numbers of ON dots, control the feeding portion such that the feed speed is changed from the first speed to the second speed, and control the printing portion such that the printing is performed sequentially one line at a time.

6 Claims, 14 Drawing Sheets

FIG. 9

141

| | FEED SPEED AT TIME OF SPECIFYING NUMBERS OF ON DOTS | | | | | | | | |
|---|---|---|---|---|---|---|---|---|---|
| | 0 | 1 | 2 | 3 | 4 | 5 | 6 | 7 | 8 |
| NUMBER OF LINES | 4 | 8 | 12 | 16 | 20 | 24 | 28 | 32 | 36 |

FIG. 10

142

| | | FEED SPEED AT TIME OF SPECIFYING NUMBERS OF ON DOTS | | | | | | | | |
|---|---|---|---|---|---|---|---|---|---|---|
| | | 0 | 1 | 2 | 3 | 4 | 5 | 6 | 7 | 8 |
| TARGET FEED SPEED | 0 | 0 | 0 | 1 | 2 | 3 | 4 | 5 | 6 | 7 |
| | 1 | 1 | 1 | 1 | 2 | 3 | 4 | 5 | 6 | 7 |
| | 2 | 1 | 2 | 2 | 2 | 3 | 4 | 5 | 6 | 7 |
| | 3 | 1 | 2 | 3 | 3 | 3 | 4 | 5 | 6 | 7 |
| | 4 | 1 | 2 | 3 | 4 | 4 | 4 | 5 | 6 | 7 |
| | 5 | 1 | 2 | 3 | 4 | 5 | 5 | 5 | 6 | 7 |
| | 6 | 1 | 2 | 3 | 4 | 5 | 6 | 6 | 6 | 7 |
| | 7 | 1 | 2 | 3 | 4 | 5 | 6 | 7 | 7 | 7 |
| | 8 | 1 | 2 | 3 | 4 | 5 | 6 | 7 | 8 | 8 |

FIG. 14

143

| | | FEED SPEED AT TIME OF SPECIFYING NUMBERS OF ON DOTS | | | | | | | | |
|---|---|---|---|---|---|---|---|---|---|---|
| | | 7 | | | | | | | | |
| TARGET FEED SPEED | | 0 | 1 | 2 | 3 | 4 | 5 | 6 | 7 | 8 |
| PROVISIONAL FEED SPEED | | 6 | 6 | 6 | 6 | 6 | 6 | 6 | 7 | 8 |
| CONTROL PULSE | 1 | 740 | 740 | 740 | 740 | 740 | 740 | 740 | 730 | 720 |
| | 2 | 750 | 750 | 750 | 750 | 750 | 750 | 750 | 730 | 710 |
| | 3 | 760 | 760 | 760 | 760 | 760 | 760 | 760 | 730 | 700 |
| | 4 | 770 | 770 | 770 | 770 | 770 | 770 | 770 | 730 | 690 |

PRINTER AND NON-TRANSITORY COMPUTER-READABLE MEDIUM

CROSS-REFERENCE TO RELATED APPLICATION

This application claims priority to Japanese Patent Application No. 2011-270238 filed on Dec. 9, 2011, the disclosure of which is herein incorporated by reference in its entirety.

BACKGROUND

The present disclosure relates to a printer that is configured to perform printing on a printing medium by using heat, and to a non-transitory computer-readable medium.

A printer is known that is configured to perform printing on a printing medium by using a thermal line head that is provided with a plurality of heating elements. The heating elements for a single line of an image that will be formed are arrayed in a main scanning direction on the thermal line head. The printer may operate the thermal line head by applying an electric current to the heating elements to generate heat.

Methods have been proposed for limiting the power that is consumed when the thermal line head is operated. For example, a method is known that detects a number of ON dots in printing data for a single line and then, based on the detected number of ON dots, controls the number of the heating elements that are heated. An outline of the method will be explained. The plurality of the heating elements that are provided in the thermal line head are divided into a plurality of blocks. In a case where the number of the detected ON dots is low, the printer heats the heating elements in all of the blocks at the same time. In this case, the printing of the entire line will be performed all at once, so the time that will be required in order to print the line may be minimized. It may therefore become possible to feed the printing medium at high speed, so high-speed printing can be performed.

On the other hand, in a case where the number of the ON dots is large, the printer heats the heating elements at a different time for each block. In this case, the printing of the line will be performed by being divided into a plurality of rounds, so the time that will be required in order to print the line will become longer than in the case where the printing of the entire line is performed all at once. It may therefore be impossible to feed the printing medium at high speed. Accordingly, the printing medium may be fed at low speed. As described above, the printer may perform printing on the printing medium while switching the feed speed of the printing medium in accordance with the number of the detected ON dots.

SUMMARY

In some cases, time may be required in order to switch the feed speed of the printing medium. Specifically, the printer may feed the printing medium by using a feed roller that is rotated by the operation of a motor. The printer of this type is not able to change the revolution speed of the motor rapidly, so time is required in order for the motor to switch to the specified revolution speed. In that case, it may take too much time before the feed roller is rotated at the revolution speed that corresponds to the detected number of the ON dots. Accordingly, the time that is required to complete the printing may become longer.

Various exemplary embodiments of the general principles described herein provide a printer and a non-transitory computer-readable medium that enable printing on a printing medium with a thermal line head in a short time.

Exemplary embodiments provide a printer that includes a feeding portion, a printing portion, and a processor. The feeding portion is configured to feed a printing medium in an auxiliary scanning direction. The printing portion includes a plurality of heating elements arrayed in a main scanning direction that is orthogonal to the auxiliary scanning direction. The heating elements are configured to perform printing of one line at a time on the printing medium fed by the feeding portion in the auxiliary scanning direction, the one line extending in the main scanning direction. The processor is configured to set, based on a first speed, a number of lines for each of which a number of ON dots is specified, among a plurality of lines that make up a printed pattern. The number of ON dots is a number of heating elements, among the plurality of heating elements, that are to be operated when the printing of one line is performed. The first speed is a feed speed of the printing medium fed by the feeding portion. The processor is also configured to specify numbers of ON dots for the set number of lines. The processor is also configured to set a second speed based on a maximum value among the specified numbers of ON dots. The second speed is a target feed speed in a case where the feed speed is changed from the first speed. The processor is further configured to control the feeding portion such that the feed speed is changed from the first speed to the second speed, and to control the printing portion such that the printing is performed sequentially one line at a time.

Exemplary embodiments also provide a non-transitory computer-readable medium that stores computer-readable instructions. The computer-readable instructions, when executed, cause a printer to perform the step of setting, based on a first speed, a number of lines for each of which a number of ON dots is specified, among a plurality of lines that make up a printed pattern. The number of the ON dots is a number of heating elements, among a plurality of heating elements of a printing portion of the printer, that are to be operated when the printing of one line is performed. The first speed is a feed speed of a printing medium fed by a feeding portion of the printer. The feeding portion is configured to feed the printing medium in an auxiliary scanning direction. The plurality of heating elements are arrayed in a main scanning direction and configured to perform printing of one line at a time on the printing medium fed by the feeding portion in the auxiliary scanning direction. The main scanning direction is orthogonal to the auxiliary scanning direction. The one line extends in the main scanning direction. The computer-readable instructions, when executed, also cause the printer to perform the steps of specifying numbers of ON dots for the set number of lines and setting a second speed based on a maximum value among the specified numbers of ON dots. The second speed is a target feed speed in a case where the feed speed is changed from the first speed. The computer-readable instructions, when executed, further cause the printer to perform the steps of controlling the feeding portion such that the feed speed is changed from the first speed to the second speed, and controlling the printing portion such that the printing is performed sequentially one line at a time.

BRIEF DESCRIPTION OF THE DRAWINGS

Exemplary embodiments will be described below in detail with reference to the accompanying drawings in which:

FIG. 9 is an explanatory figure of an example of a first table 141;

FIG. 10 is an explanatory figure of an example of a second table 142;

FIG. 14 is an explanatory figure of an example of a third table 143.

DETAILED DESCRIPTION

Hereinafter, an embodiment will be explained with reference to the drawings.

Figure 1:
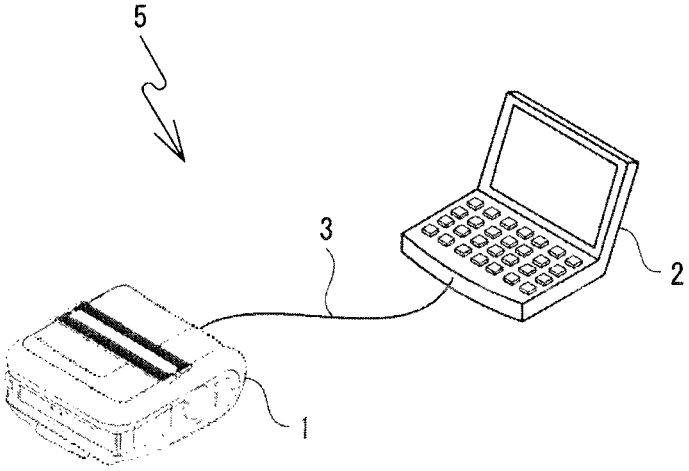
FIG. 1 is a figure that shows a general configuration of a printing system 5.

An overview of a printing system 5 will be explained with reference to FIG. 1. The printing system 5 includes a printer 1 and an external terminal 2. The printer 1 and the external terminal 2 may be connected to one another by a USB cable 3, for example. The printer 1 is configured to print characters, graphics, and the like that form a printed pattern on a heat-sensitive tape 8 that is a printing medium (refer to FIG. 6). After the printing, a user may create a label by cutting off the portion of the heat-sensitive tape 8 on which the characters, graphics, and the like have been printed. The printer 1 may perform the printing by operating based on printing data that are received from the external terminal 2. The external terminal 2 may be a general-purpose personal computer, for example. The external terminal 2 may create the printing data that are required when the printer 1 performs printing. The user is able to edit the printing data through a keyboard and a mouse of the external terminal 2.

The configuration of the printer 1 will be explained with reference to FIGS. 2 to 4. The lower right, the upper left, the upper right, the lower left, the upward direction, and the downward direction in FIG. 2 are respectively defined as the right, the left, the rear, the front, the top, and the bottom sides of the printer 1.

Figure 2:
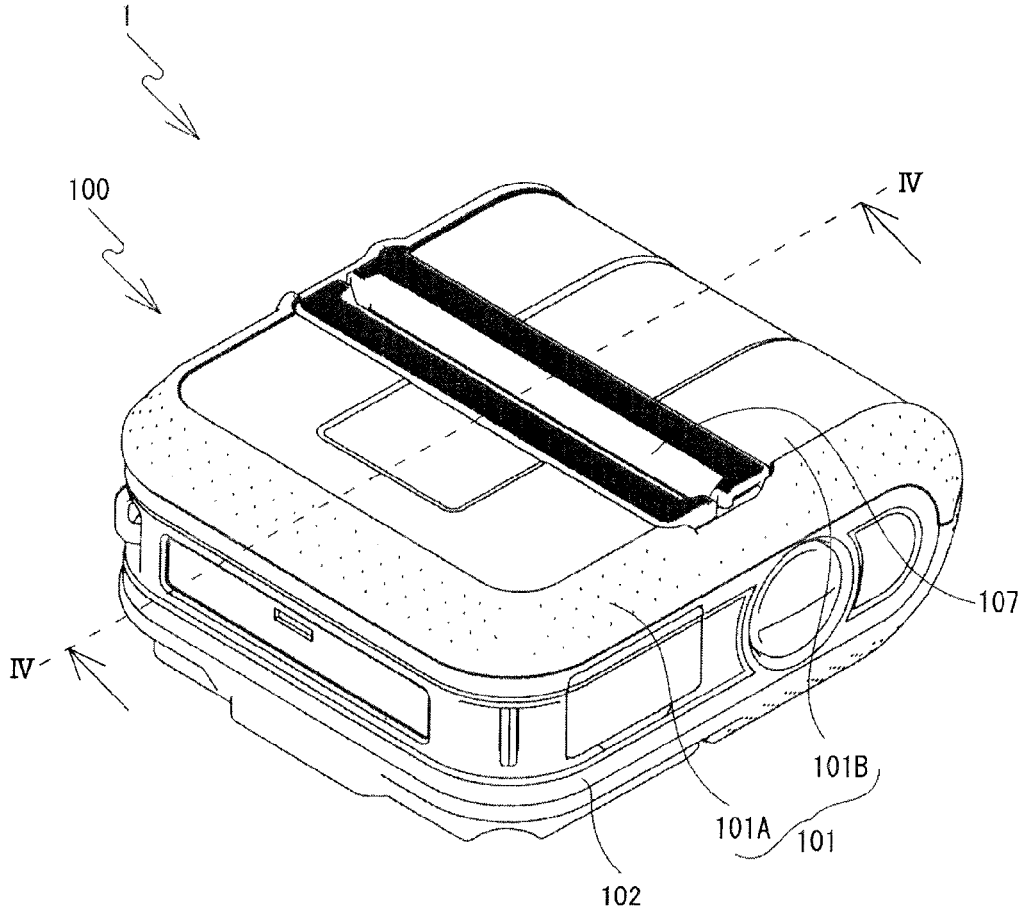
FIG. 2 is an oblique view of a printer 1.

As shown in FIG. 2, the printer 1 includes a housing 100. The housing 100 is approximately box-shaped. The housing 100 is formed by a top cover 101 and a bottom cover 102. The top cover 101 is provided on the top side of the housing 100. The bottom cover 102 is provided on the bottom side of the housing 100. The top cover 101 includes a fixed portion 101A and a lid 101B. The fixed portion 101A is the front portion of the top cover 101. The lid 101B is the rear portion of the top cover 101.

Figure 3:
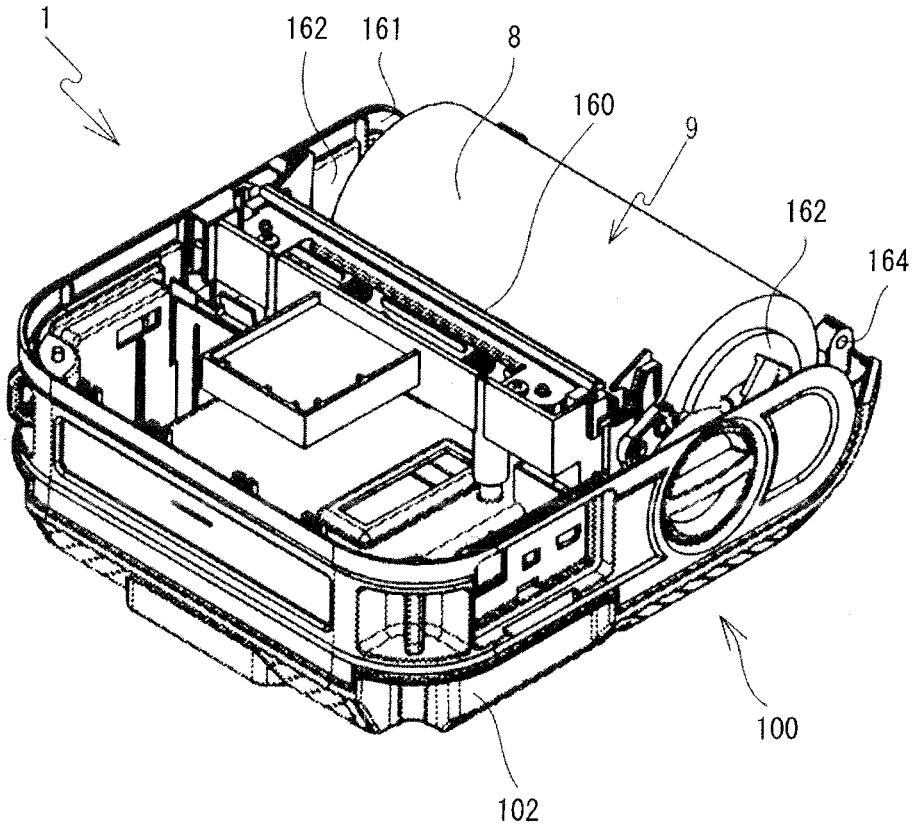
FIG. 3 is an oblique view of the printer 1 in a state in which a top cover 101 has been removed.

As shown in FIG. 3, a roll containing portion 161 is provided underneath the lid 101B (refer to FIG. 2). A roll 9, around which the heat-sensitive tape 8 is wound, may be mounted in the roll containing portion 161. Supporting members 162 may be attached to both ends of the roll 9. The roll 9 may be rotatably supported by the supporting members 162. The roll 9 is thus able to supply the heat-sensitive tape 8 continuously from the roll containing portion 161. A hinge 164 rotatably supports the rear edge of the lid 101B. The lid 101B may be opened and closed by swinging its front edge up and down around the rear edge as its axis. With the lid 101B in the open state, the roll containing portion 161 is exposed. The user is therefore able to perform mounting and replacement of the roll 9 easily.

Figure 4:
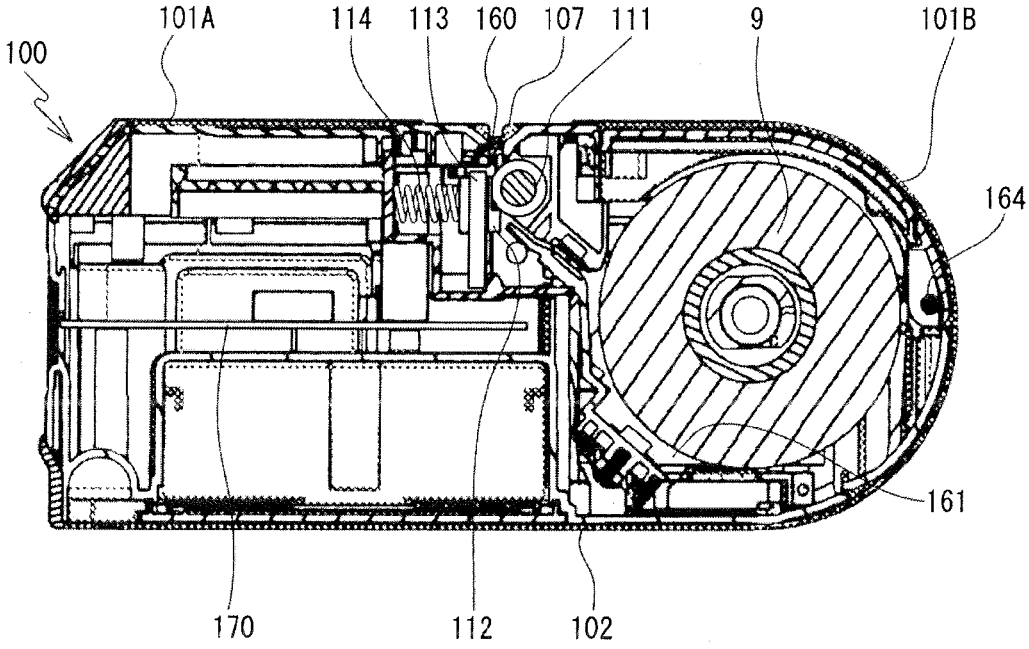
FIG. 4 is a sectional view along a line IV-IV in FIG. 2 as seen in the direction of arrows.

As shown in FIG. 4, a discharge outlet 107 is provided between the fixed portion 101A and the lid 101B, approximately in the center of the top cover 101 (refer to FIG. 2) in the front-rear direction. The portion of the heat-sensitive tape 8 on which the printing has been performed may pass from the inside to the outside of the housing 100 through the discharge outlet 107. The heat-sensitive tape 8 may thus be discharged from the inside to the outside of the housing 100 in this way. A platen roller 111 is rotatably supported below the front edge of the lid 101B. A drive motor 18 (refer to FIG. 5) is provided inside the housing 100. The drive motor 18 is connected to the platen roller 111 through a gear train (not shown in the drawings). The drive motor 18 may rotate the platen roller 111 by transmitting a rotational driving force to the platen roller 111 through the gear train.

A thermal line head 112, a fixing plate 113, and a spring 114 are provided below the rear edge of the fixed portion 101A. The fixing plate 113 is provided in front of the platen roller 111. The fixing plate 113 extends in the left-right direction such that its faces are oriented in the front-rear direction. The thermal line head 112 is provided on the rear face of the fixing plate 113. The thermal line head 112 extends in the left-right direction. The thermal line head 112 has a structure in which a plurality of heating elements are arrayed in a single row in the left-right direction. Each of the heating elements is configured to generate heat, when an electric current is applied, to form one dot on the heat-sensitive tape 8. The plurality of the heating elements that are arrayed in the single row correspond to one line in an image that is formed on the heat-sensitive tape 8. The spring 114 energizes the fixing plate 113 toward the rear.

A cutting blade 160 is provided above the thermal line head 112. The cutting blade 160 extends along the discharge outlet 107 in the left-right direction. The user can cut the heat-sensitive tape 8 manually by pulling the heat-sensitive tape 8 that has been discharged from the discharge outlet 107 toward the front and pressing it against the cutting blade 160.

The process to create a label will be explained. The heat-sensitive tape 8 that has been fed out from the roll 9 is inserted between the platen roller 111 and the thermal line head 112 from the bottom toward the top. The spring 114 energizes the fixing plate 113 toward the rear, causing the thermal line head 112 to press the heat-sensitive tape 8 against the platen roller 111 with a specified force. In this state, an electric current is selectively applied to the plurality of the heating elements of the thermal line head 112 to generate heat. Images of pixels are formed on the heat-sensitive tape 8 that correspond to the individual ones of the plurality of the heating elements that have generated heat, such that one line of the image is printed. At the same time, the platen roller 111 rotates as the drive motor 18 turns. This causes the heat-sensitive tape 8 to be fed out sequentially from the roll 9 and to be fed upward from below. Hereinafter, the left-right direction, which is the direction in which the plurality of the heating elements are lined up in the thermal line head 112, will also be called the main scanning direction. The direction in which the heat-sensitive tape 8 is fed will also be called the auxiliary scanning direction. The main scanning direction and the auxiliary scanning direction are orthogonal to one another. The image of the characters and graphics is ultimately printed on the heat-sensitive tape 8 by the forming in the auxiliary scanning direction of a series of images of individual lines that each extend in the main scanning direction.

After the printing, the heat-sensitive tape 8 is discharged to the outside of the housing 100 from the discharge outlet 107, which is located on the downstream side of the platen roller 111 and the thermal line head 112 in the feed direction. The discharged heat-sensitive tape 8 is cut by the cutting blade 160 that is provided along the discharge outlet 107. The label is thus created.

Figure 5:
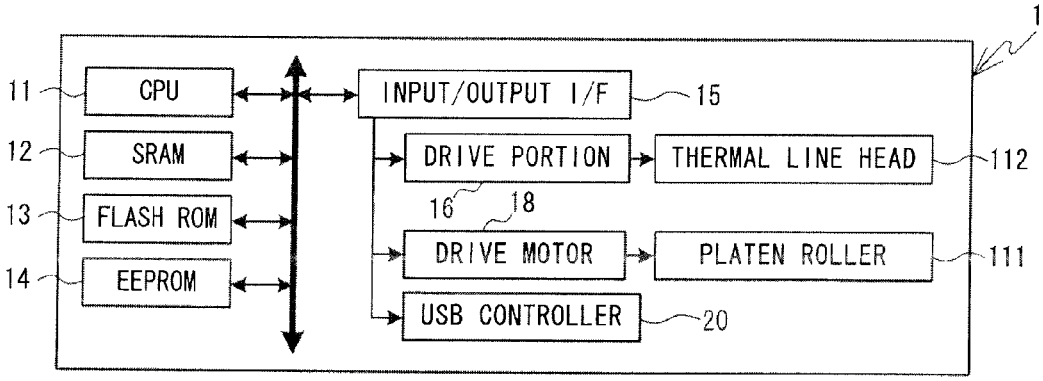
FIG. 5 is a block diagram that shows an electrical configuration of the printer 1.

The electrical configuration of the printer 1 will be explained with reference to FIG. 5. The printer 1 includes a CPU 11, an SRAM 12, a flash ROM 13, an EEPROM 14, an input/output interface (I/F) 15, a drive portion 16, the drive motor 18, the thermal line head 112, the platen roller 111, and a USB controller 20. The CPU 11, the SRAM 12, the flash ROM 13, the EEPROM 14, the input/output I/F 15, the drive portion 16, and the USB controller 20 are mounted on a control board 170 (refer to FIG. 4). The control board 170 is provided in the front portion of the interior of the housing 100.

The CPU 11 is configured to perform overall control of the printer 1. The flash ROM 13 is a rewriteable non-volatile storage element. A control program, a first table 141 (refer to FIG. 9) and a second table 142 (refer to FIG. 10), which will be described later, and the like may be stored in the flash ROM 13. The printing data that have been received from the external terminal 2 and other data may be temporarily stored in the SRAM 12. The input/output I/F 15 may transmit data and control signals between the CPU 11 on one side and the drive portion 16, the drive motor 18, and the USB controller 20 on the other side. The drive portion 16 may drive the thermal line head 112 in accordance with the control of the CPU 11. The drive motor 18 may operate in accordance with the control by the CPU 11 and drives the platen roller 111 through the gear train. The USB controller 20 is a device for performing communication with the external terminal 2 through the USB cable 3.

A method for controlling a feed speed of the heat-sensitive tape 8 (hereinafter simply called the feed speed) will be explained. The thermal line head 112 may heat the heating elements by applying an electric current to the heating elements. Hereinafter, this operation of the thermal line head 112 is called operating the heating elements. As the number of the heating elements that are operated increases, the electric current that is consumed by the entire thermal line head 112 increases. Therefore, the printer 1 may ordinarily restrict the number of the heating elements that can be operated at the same time. The printer 1 may thus hold down the peak value of the electric current that is consumed by the thermal line head 112.

When the printer 1 prints a single line of an image by using the thermal line head 112, the single line may include pixels where dots are formed and pixels where dots are not formed. The number of the heating elements that are operated (hereinafter called the number of ON dots) varies according to the number of the pixels where dots are formed. In a case where the number of the ON dots is large, the printer 1 does not operate a large number of the heating elements all at once. Specifically, the printer 1 divides the plurality of the heating elements into a plurality of groups and operates the heating elements on a time division basis, operating each of the groups separately in a plurality of rounds. In the case of a line in which the number of the ON dots is large, the number of the groups becomes greater. Therefore, the number of rounds in which the individual groups of the heating elements are operated also becomes greater. This means that in the case of a line in which the number of the ON dots is large, the printer 1 requires more time to complete the printing of the line than it does in the case of a line in which the number of the ON dots is low.

Therefore, in a case where the printer 1 performs the printing of a line in which the number of the ON dots is large, the printer 1 reduces the revolution speed of the platen roller 111 and makes the feed speed slower. The printer 1 can thus reliably perform the printing of the single line by preventing the heat-sensitive tape 8 from being fed too far before the printing of the single line is completed. In contrast, in a case where the printer 1 performs the printing of a line in which the number of the ON dots is low, the time until the printing of the single line is completed is shorter, so the printer 1 increases the revolution speed of the platen roller 111 and makes the feed speed faster. The printer 1 can thus shorten the time that is required for the printing on the heat-sensitive tape 8 to be completed. In this manner, the printer 1 can optimize the processing for the printing on the heat-sensitive tape 8 by controlling the revolution speed of the platen roller 111 such that the heat-sensitive tape 8 is fed at a feed speed that corresponds to the number of the ON dots.

The platen roller 111 rotates in conjunction with the rotation of the drive motor 18. The time that is required in order to change the revolution speed of the drive motor 18 becomes longer as the amount of the change in the revolution speed becomes greater. Therefore, in a case where it is necessary for the printer 1 to change the feed speed rapidly, it takes some time until the drive motor 18 is made to turn at the changed revolution speed. That means that in a case where the number of the ON dots changes abruptly, there is a possibility that the printer 1 will not be able to immediately start feeding the heat-sensitive tape 8 at the feed speed that corresponds to the number of the ON dots. Accordingly, in order to respond to a sudden change in the feed speed, the printer 1 may control the revolution speed of the drive motor 18 that drives the platen roller 111 by using a known method in a related art hereinafter described to specify the number of the ON dots.

The known method in the related art for controlling the feed speed will be explained in specific terms with reference to FIG. 6, using an example of the printing on the heat-sensitive tape 8 of a printed pattern that is formed of line segments 61 to 64. In a line graph 71 and a bar graph 72 in FIG. 6, the horizontal axes indicate lines for which the printing is performed by the thermal line head 112. The CPU 11 prints the line segments 61 to 64 one line at a time on the heat-sensitive tape 8 by controlling the thermal line head 112 and operating the heating elements on a cycle T. The CPU 11 also controls the revolution speed of the drive motor 18 by transmitting a control pulse to the drive motor 18 on a cycle that is the same as the cycle T. Therefore, the horizontal axes also indicate the total number of the control pulses that are transmitted from the CPU 11 to the drive motor 18.

The vertical axis of the line graph 71 indicates the feed speed at a total of nine levels, from zero to eight. The minimum feed speed is zero. The maximum feed speed is eight. The CPU 11 changes the revolution speed of the drive motor 18 through nine levels. That is, the CPU 11 adjusts the speed of feed by the platen roller 111 through nine levels.

The bar graph 72 shows the lines for which the CPU 11 specifies the numbers of the ON dots. The CPU 11 specifies the numbers of the ON dots for the lines in each of the ranges that are indicated by the horizontal bars when the line that corresponds to the left end of each of the horizontal bars is printed. Based on the specified numbers of the ON dots, the CPU 11 adjusts the feed speed by controlling the revolution speed of the drive motor 18. This will be described in detail later.

Within the line in the line graph 71, the absolute value of the slopes of the portions that correspond to the 80th to the 96th, the 144th to the 160th, the 192nd to the 224th, the 256th to the 288th, and the 320th to the 352nd lines is ¼. That means that four control pulses must be transmitted to the drive motor 18 in order to change the feed speed by one level. Therefore, a period of time that is four times the cycle T (a time 4T) is required in order to change the feed speed by one level. A time 32T is required in order to change the feed speed from zero to 8 (the 192nd to the 224th, the 256th to the 288th, and the 320th to the 352nd lines). Thirty-two control pulses are required.

For example, in a case where the line segments 62, 63, 64, which are orthogonal to the auxiliary scanning direction, are printed, the number of the ON dots changes abruptly before and after the lines on which the line segments 62, 63, 64 are printed. Accordingly, the CPU 11 needs to change the feed speed rapidly. Specifically, in a case where the number of the ON dots increases, the CPU 11 needs to make the feed speed slower, and in a case where the number of the ON dots decreases, the CPU 11 needs to make the feed speed faster. However, as described above, a specified time is required in order to change the revolution speed of the drive motor 18. Therefore, the CPU 11 specifies the respective numbers of the ON dots in advance for a specified number of lines. In a case where it is necessary to change the revolution speed of the drive motor 18, the CPU 11 changes the revolution speed of the drive motor 18 gradually in advance. This will be explained in detail below.

The CPU 11 specifies the respective numbers of the ON dots for 64 lines in each of repeated intervals of 32T. A horizontal bar 81 indicates that the respective numbers of the ON dots are specified for the 1st to the 64th lines at the time when the 1st line is printed. In the same manner, a horizontal bar 82 indicates that the respective numbers of the ON dots are specified for the 33rd to the 96th lines at the time when the 32nd line is printed. A horizontal bar 83 indicates that the respective numbers of the ON dots are specified for the 65th to the 128th lines at the time when the 64th line is printed. The reason why the number of the lines for which the numbers of the ON dots are specified (hereinafter called the number of the lines) is 64 will be explained later. The CPU 11 then specifies the maximum value among the specified numbers of the ON dots. The reason for specifying the maximum value will now be explained. If the feed speed is not decreased in a case where the number of the ON dots is large, the heat-sensitive tape 8 may be fed too far before the thermal line head 112 completes the printing of the current line. As a consequence, the printing of the current line may fail. In contrast, in a case where the number of the ON dots is low, the result of the printing by the thermal line head 112 may not be affected even if the feed speed is slow. Therefore, the CPU 11 optimizes the feed speed in accordance with the maximum value among the numbers of the ON dots. Based on the maximum value among the numbers of the ON dots, the CPU 11 sets 32 control pulses to be transmitted to the drive motor 18 and sequentially transmits the control pulses to the drive motor 18. In this manner, the CPU 11 changes the revolution speed of the drive motor 18 in advance, such that the change in the feed speed will be completed in time for the printing of the line that corresponds to the maximum number of the ON dots.

For example, the printing of the line segment 62 is to be performed at the 112th line. Accordingly, in the case where the CPU 11 specifies the respective numbers of the ON dots for the 65th to the 128th lines at the time when the 64th line is printed (the horizontal bar 83), the CPU 11 specifies a number X of the ON dots in the 112th line, where the printing of the line segment 62 is performed, as the maximum value among the numbers of the ON dots. The feed speed when the 64th line is printed is 8. In a case where the feed speed that is required for the printing of the 112th line with the number X of the ON dots is 4, it is necessary for the CPU 11 to decrease the feed speed by four levels, that is, to reduce the speed from 8 to 4.

The CPU 11 sets 32 control pulses for reducing the feed speed from 8 to 4. Sixteen (4×4) control pulses are required in order to reduce the feed speed from 8 to 4. Therefore, the CPU 11 sets the control pulses such that the sixteen pulses that are the first half of the 32 control pulses maintain the feed speed at 8, and then the remaining sixteen pulses reduce the feed speed from 8 to 4. Starting from the time when the printing of the next line, the 65th line, is performed, the CPU 11 sequentially transmits the set control pulses to the drive motor 18, transmitting one control pulse in each of the cycles T (for the 65th to the 96th lines). This causes the drive motor 18 to start decelerating at the time that the printing of the 81st line (the 65th line plus 16) is performed. The feed speed starts to decrease at the time that the printing of the 81st line is performed and decreases gradually from 8 to 4 (the descending line segment 91 in the line graph 71). The feed speed becomes 4 at the time when the printing of the 96th line is performed.

In a case where the CPU 11 specifies the respective numbers of the ON dots for the 97th to the 160th lines at the time when the 96th line is printed (the horizontal bar 84), the CPU 11 specifies the number X of the ON dots in the 112th line, where the printing of the line segment 62 is performed, as the maximum value among the numbers of the ON dots. The feed speed that corresponds to the number X of the ON dots is 4, which is the same as the feed speed 4 when the 96th line is printed. Therefore, the CPU 11 sets the 32 control pulses for maintaining the feed speed at 4. Starting from the time when the printing of the next line, the 97th line, is performed, the CPU 11 sequentially transmits the set control pulses to the drive motor 18, transmitting one control pulse in each of the cycles T (for the 97th to the 128th lines). This causes the feed speed to be maintained at 4 (the horizontal line segment 92 in the line graph 71) at the time when the printing of the line segment 62 is performed at the 112th line. By feeding the heat-sensitive tape 8 at the feed speed 4, which has been optimized in accordance with the number of the ON dots, the thermal line head 112 can reliably print the line segment 62 on the heat-sensitive tape 8.

Note that in the case where the CPU 11 decreases the feed speed from 4 to zero (the descending line segment 93 in the line graph 71) in order to perform the printing of the line segment 63 at the 176th line, the CPU 11 optimizes the feed speed by controlling the revolution speed of the drive motor 18 by the same method as that described above.

Within the range of the 193rd to the 256th lines, the printing of the line segment 63 has already been completed. Therefore, only the printing of the line segment 61 is performed. Accordingly, in the case where the CPU 11 specifies the respective numbers of the ON dots for the 193rd to the 256th lines at the time when the printing of the 192nd line is performed (the horizontal bar 86), the maximum value among the specified numbers of the ON dots is low. Therefore, it is necessary for the CPU 11 to increase the feed speed from zero to 8 at the time when the printing of the 193rd line is performed.

Accordingly, the CPU 11 sets the 32 control pulses for increasing the feed speed from zero to 8. The number of the control pulses that is required in order to increase the feed speed from zero to 8 is 32 (4×8). Therefore, the CPU 11 sets the control pulses such that the feed speed will be increased from zero to 8 by the 32 control pulses. Starting from the time when the printing of the next line, the 193rd line, is performed, the CPU 11 sequentially transmits the set control pulses to the drive motor 18, transmitting one control pulse in each of the cycles T (for the 193rd to the 224th lines). This causes the drive motor 18 to start accelerating at the time that the printing of the 193rd line is performed. The feed speed starts to increase at the time that the printing of the 193rd line is performed and increases from zero to 8 (the ascending line segment 94 in the line graph 71). The feed speed becomes 8 at the time when the printing of the 224th line is performed.

The number of the control pulses that is required in order to decrease the feed speed from 8 to zero for performing the printing of the line segment 64 at the 304th line (for which the number of the ON dots is 2×) is 32 (4×8). Therefore, in the case where the CPU 11 specifies the respective numbers of the ON dots for the 257th to the 288th lines at the time when the printing of the 256th line is performed (the horizontal bar 88), the CPU 11 sets the control pulses such that the feed speed will be decreased from 8 to zero by the 32 control pulses. Starting from the time when the printing of the next line, the 257th line, is performed, the CPU 11 sequentially transmits the set control pulses to the drive motor 18, transmitting one control pulse in each of the cycles T (for the 257th to the 288th lines). This causes the drive motor 18 to start decelerating at the time that the printing of the 257th line is performed. The feed speed starts to decrease at the time that the printing of the 257th line is performed and decreases from 8 to zero (the descending line segment 95 in the line graph 71). The feed speed becomes zero at the time when the printing of the 288th line is performed. This causes the feed speed to become zero at the time when the printing of the line segment 64 is performed at the 304th line. By feeding the heat-sensitive tape 8 at the feed speed zero, which has been optimized in accordance with the number of the ON dots 2X, the thermal line head 112 can reliably print the line segment 64 on the heat-sensitive tape 8.

With the known method that is described above, in order to appropriately control the feed speed when the printing of a target line is performed, it is necessary for the number of lines for which the numbers of the ON dots are specified to be 64. The reason for this will be explained. In a case where the amount of the change in the feed speed is the maximum (the case of a change from zero to 8 or the case of a change from 8 to zero), it is necessary to transmit 32 control pulses before the change in the feed speed is completed. Furthermore, with the method that is described above, the CPU 11 controls the revolution speed of the drive motor 18 by setting the control pulses in units of 32 pulses. Therefore, in a case where the number of the lines for which the numbers of the ON dots are specified is 32, the possibility exists that the control of the feed speed could not be completed before the printing of the target line is performed, depending on the time at which the control of the drive motor 18 starts. Therefore, with the method that is described above, the number of lines for which the numbers of the ON dots are specified is defined as 64, which is greater than 32. This makes it possible for the CPU 11 to reliably complete the control of the feed speed before the printing of the target line is performed.

Figure 7:
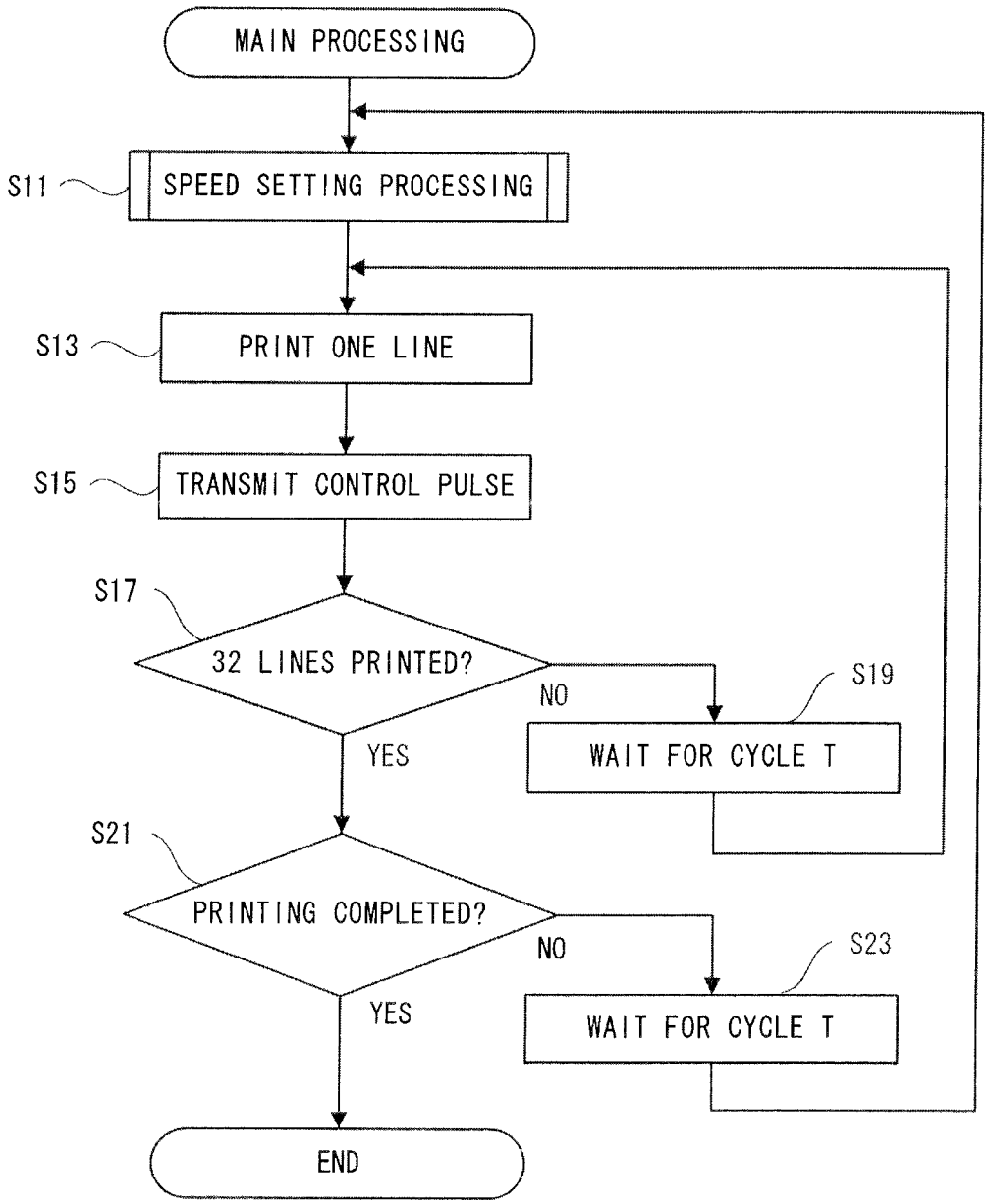
FIG. 7 RELATED ART
FIG. 7 is a flowchart of main processing in the related art.
Figure 8:
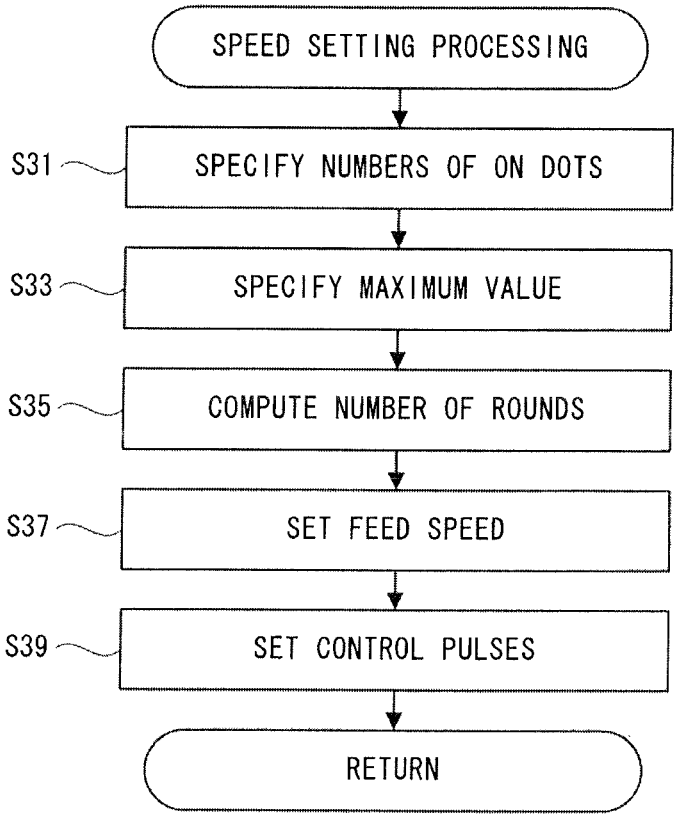
FIG. 8 RELATED ART
FIG. 8 is a flowchart of speed setting processing in the related art.

The processing (main processing) in a case where the CPU 11 performs the control according to the known method that is described above will be explained in specific terms with reference to FIGS. 7 and 8. As shown in FIG. 7, the CPU 11 first performs processing (speed setting processing; refer to FIG. 8) that sets the feed speed based on the numbers of the ON dots (Step S11). As shown in FIG. 8, in the speed setting processing, the CPU 11 first specifies the numbers of the ON dots for 64 lines, based on the printing data (Step S31). For example, the CPU 11 acquires one line's worth of the printing data that have been transmitted from the external terminal 2 and stored in the SRAM 12 and specifies the number of the ON dots for that one line. By repeating the same processing for a total of 64 lines, the CPU 11 specifies the respective numbers of the ON dots for the 64 lines. The CPU 11 specifies the maximum value among the specified numbers of the ON dots for the 64 lines (Step S33). The CPU 11 computes the number of the groups of the heating elements by dividing the maximum value for the specified numbers of the ON dots by the number of the heating elements that can be operated at the same time. The CPU 11 operates the heating elements in group units over a plurality of rounds. Therefore, the computed number of groups is equivalent to the number of rounds of operation when the heating elements are operated sequentially in group units for printing a line that has the maximum number of the ON dots (Step S35). Based on the computed number of rounds of operation, the CPU 11 sets the optimum feed speed to one of the nine levels (Step S37). For example, the CPU 11 may set the optimum feed speed by referring to a table that is stored in advance in the flash ROM 13 and that defines correspondence relationships between the numbers of rounds and the optimum feed speeds, although this is not shown in the drawings. Based on the current feed speed and the feed speed that was set at Step S37, the CPU 11 sets the 32 control pulses for operating the drive motor 18 (Step S39). The CPU 11 terminates the speed setting processing and returns to the main processing (refer to FIG. 7).

As shown in FIG. 7, after the speed setting processing (Step S11) is terminated, the CPU 11 performs the printing of one line based on the printing data (Step S13). The CPU 11 selects the control pulse that corresponds to the current line from among the control pulses that were set at Step S39 (refer to FIG. 8) and transmits it to the drive motor 18 (Step S15). The CPU 11 thus controls the revolution speed of the drive motor 18. Because the platen roller 111 rotates in conjunction with the turning of the drive motor 18, the feed speed is adjusted in accordance with the revolution speed of the drive motor 18. The CPU 11 determines whether the printing of 32 lines has been completed (Step S17). In a case where the printing of 32 lines has not been completed (NO at Step S17), the CPU 11 waits for one cycle T (Step S19). The CPU 11 returns to the processing at Step S13 so that the printing of the remaining lines among the 32 lines will be continued.

In a case where the printing of the 32 lines has been completed by the repeated performing of the printing of the one line at Step S13 (YES at Step S17), the CPU 11 determines whether the printing of all of the lines has been completed, based on the printing data (Step S21). In a case where the printing of all of the lines has not been completed (NO at Step S21), the CPU 11 waits for one cycle T (Step S23). The CPU 11 returns to the processing at Step S11 so that the printing of the remaining lines will be continued. On the other hand, in a case where the printing of all of the lines has been completed (YES at Step S21), the CPU 11 terminates the main processing.

With the known method that is explained above, because the interval at which the numbers of the ON dots are specified is 32T, and the number of lines for which the numbers of the ON dots are specified is 64, the control of the feed speed is completed appropriately before the printing of the target line is performed. However, with this method, the feed speed is decreased ahead of time, so the time that is required in order to complete the printing of all of the lines may become longer.

Figure 6:
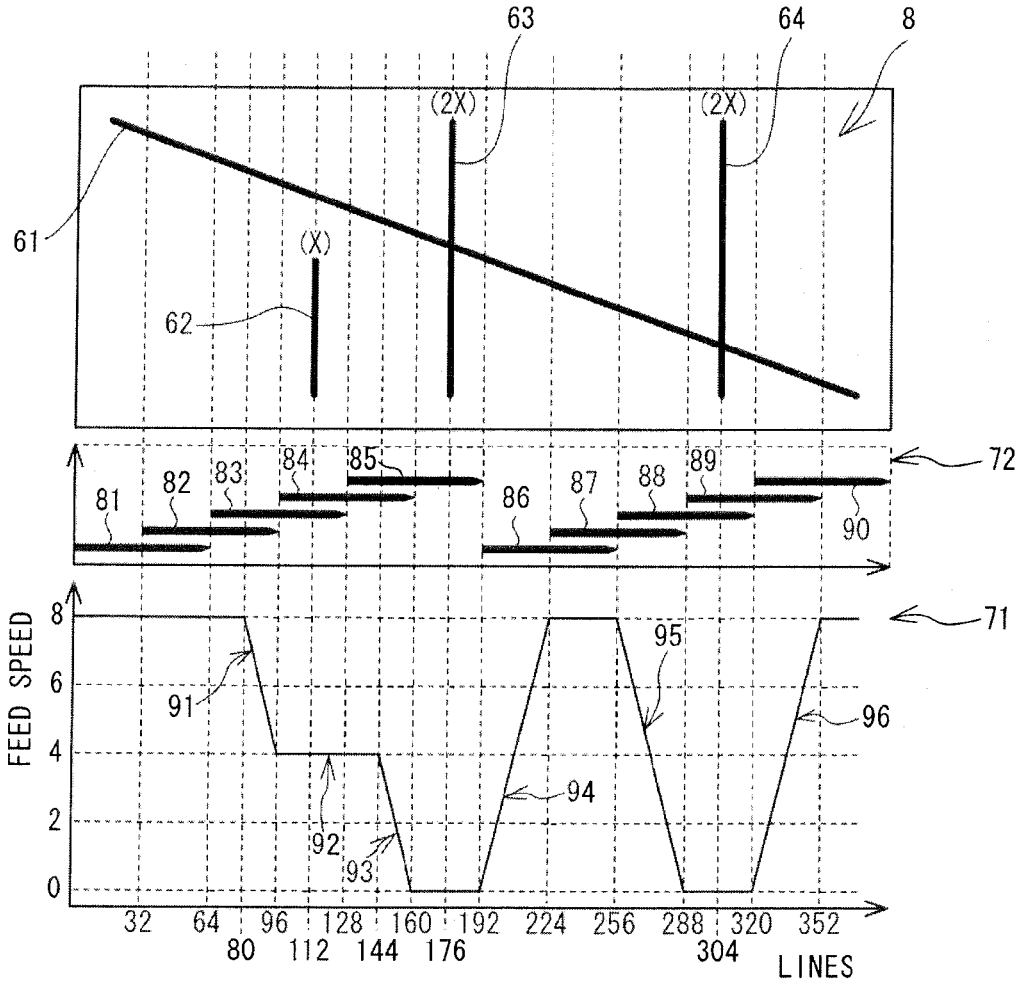
FIG. 6 RELATED ART
FIG. 6 is an explanatory figure of transitions in a feed speed in a related art.

For example, in the example that is shown in FIG. 6, in order for the thermal line head 112 to perform the printing of the line segment 64 at the 304th line, the feed speed has already been reduced to zero at the time that the printing of the 288th line is performed. That means that the feed speed is zero during the period when the printing of the 288th to the 303rd lines is being performed. The numbers of the ON dots for the 288th to the 303rd lines are low, so it would be possible to perform the printing of those lines even if the feed speed was fast. Therefore, if it were possible to increase the feed speed during the period when the printing of the 288th to the 303rd lines is being performed, the time that is required in order to complete the printing of all of the lines could be shortened.

Accordingly, in the present embodiment, the interval at which the numbers of the ON dots are specified is defined as 4T, not 32T. Furthermore, the number of lines for which the numbers of the ON dots are specified is not fixed at 64, but is varied in the range from 4 to 36. The number of lines for which the numbers of the ON dots are specified is set based on the feed speed at the time when the numbers of the ON dots are specified. This makes it possible to optimize the conformity of the feed speed to the changes in the number of the ON dots. Therefore, even as the printer 1 controls the feed speed appropriately and performs the printing on the heat-sensitive tape 8, it is able to make the time that is required in order to complete the printing of all of the lines shorter than it is with the known method that is shown in FIGS. 6 to 8. This will hereinafter be described in detail.

The printer 1 specifies the number of lines by referring to the first table 141, an example of which is shown in FIG. 9. The first table 141 is a table that defines correspondence relationships between the feed speeds at the time when the numbers of the ON dots are specified and the numbers of lines for which the numbers of the ON dots are specified. For example, in a case where the feed speed is zero at the time when the numbers of the ON dots are specified, the number of lines is set to 4. The correspondence relationships between the other feed speeds at the time when the numbers of the ON dots are specified and the numbers of lines, if expressed in the form of feed speed/number of lines, are 1/8, 2/12, 3/16, 4/20, 5/24, 6/28, 7/32, and 8/36. Thus the number of lines for which the numbers of the ON dots are specified increases as the feed speed increases. The reason for this will hereinafter be described.

A specified period of time is required in order to change the revolution speed of the drive motor 18. Accordingly, the time it takes until the drive motor 18 turns at the changed revolution speed becomes greater, as the amount of the change in the revolution speed becomes greater. Therefore, for the printer 1 to be able to respond to a large change in the feed speed, it is necessary for the printer 1 to specify the numbers of the ON dots in advance for a large number of lines. For example, in a case where the feed speed is 8, the maximum amount of the change in the feed speed is 9 (the amount of the change from 8 to the minimum feed speed of zero). In a case where the feed speed is 4, the maximum amount of the change in the feed speed is 4 (the amount of the change from 4 to the minimum feed speed of zero, and the amount of the change from 4 to the maximum feed speed of 8). Thus, to the extent that the feed speed at the time that the numbers of the ON dots are specified is a value that is close to one of the maximum feed speed and the minimum feed speed, the more possible it becomes for the amount of change in the feed speed to become large.

Furthermore, if the feed speed is not decreased in a case where the number of the ON dots is large, the heat-sensitive tape 8 may be fed too far before the thermal line head 112 completes the printing of the current line, such that the printing of the current line may fail. Therefore, in a case where the printer 1 decreases the feed speed, it is necessary for the printer 1 to complete the control of the feed speed by the time that the printing of the target line is performed. In contrast, in a case where the number of the ON dots is low, the printing by the thermal line head 112 will not fail even if the feed speed is slow. Therefore, in a case where the printer 1 increases the feed speed, no problems will occur, even if the control of the feed speed is not completed by the time that the printing of the target line is performed.

Therefore, in the first table 141, the correspondence relationships are defined such that the number of lines for which the numbers of the ON dots are specified increases as the difference between the minimum feed speed of zero and the feed speed at the time when the numbers of the ON dots are specified becomes greater, that is, as the feed speed becomes closer to the maximum feed speed of 8. In contrast, the correspondence relationships are defined such that the number of lines for which the numbers of the ON dots are specified decreases as the difference between the minimum feed speed of zero and the feed speed at the time when the numbers of the ON dots are specified becomes less, that is, as the feed speed becomes closer to the minimum feed speed of zero. The printer 1 is thus able to ensure sufficient time for decreasing the feed speed to the minimum feed speed of zero. Therefore, the printer 1 is able to change the feed speed appropriately. Moreover, in a case where the difference between the minimum feed speed of zero and the feed speed at the time when the numbers of the ON dots are specified is large, the number of lines for which the numbers of the ON dots are specified is increased. Therefore, the numbers of the ON dots for the lines can be specified, and the appropriate feed speed can be determined, farther in advance. It is therefore possible for the printer 1 to reliably ensure sufficient time for decreasing the feed speed to the minimum feed speed of zero.

The printer 1 adjusts the feed speed by referring to the second table 142, an example of which is shown in FIG. 10. The second table 142 is a table that, in a case where the feed speed at the time when the numbers of the ON dots are specified will be gradually changed to the feed speed that is set based on the number of the ON dots (hereinafter called the target feed speed), defines the manner in which the feed speed will be changed within the time period 4T until the next time the number of the ON dots is specified.

For example, in a case where the feed speed at the time when the numbers of the ON dots are specified is 8, and the target feed speed is any one from zero to 7, the feed speed is changed to 7 within the time period 4T. In a case where the feed speed at the time when the numbers of the ON dots are specified is 8, and the target feed speed is 8, the feed speed is maintained at 8 within the time period 4T. In a case where the feed speed at the time when the numbers of the ON dots are specified is 7, and the target feed speed is any one from zero to 6, the feed speed is changed to 6 within the time period 4T. In a case where the feed speed at the time when the numbers of the ON dots are specified is 7, and the target feed speed is 8, the feed speed is changed to 8 within the time period 4T.

The drive motor 18 requires 4 control pulses in order to change the revolution speed by one level. The cycle on which the control pulses are transmitted is T, so the maximum amount of change that can be made in the feed speed within the time period 4T is one level. Therefore, in a case where the feed speed of 8 at the time when the numbers of the ON dots are specified will be changed to the target feed speed of zero, for example, the feed speed is changed from 8 to 7 in the first time period 4T, and the feed speed is changed from 7 to 6 in the next time period 4T. By passing through the levels in this manner, the feed speed becomes zero after a time period of 32T (4T×8). Hereinafter, in a case where the feed speed is changed within the time period 4T, the new feed speed after the change that is determined based on the second table 142 will be called the provisional feed speed.

Figure 11:
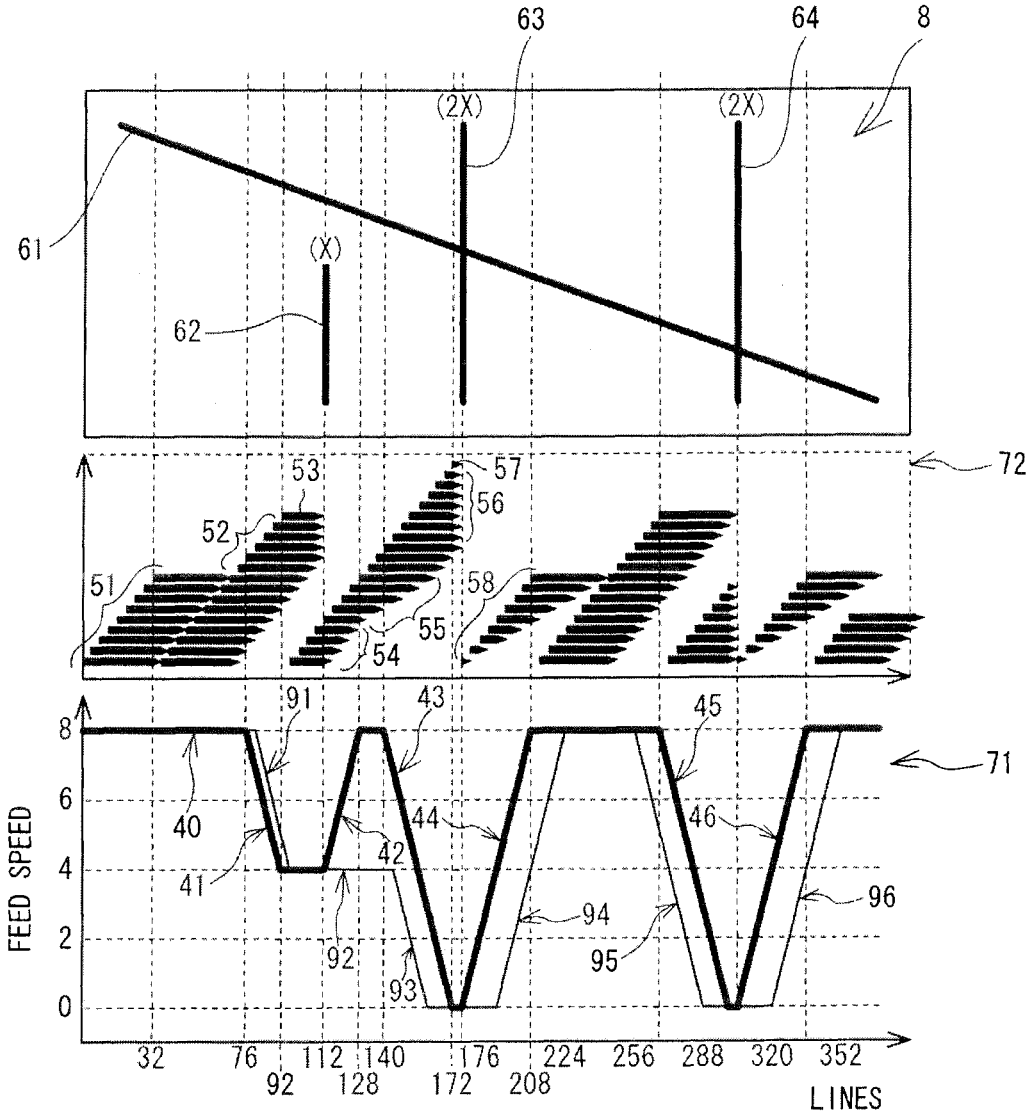
FIG. 11 is an explanatory figure of transitions in a feed speed in an embodiment.

The method for controlling the feed speed in the present embodiment will be explained in specific terms with reference to FIG. 11. During the time while the printing of the 1st to the 75th lines is being performed, only the line segment 61 is printed. Accordingly, within the range of the 1st to the 75th lines, the number of the ON dots in each line is low. Therefore, the CPU 11 sets the feed speed to 8 (the horizontal line segment 40 in the line graph 71). In the first table 141 (refer to FIG. 9), the number of lines that corresponds to the feed speed of 8 is 36. Therefore, while the printing of the 1st to the 75th lines is being performed, the CPU 11 specifies the respective numbers of the ON dots for 36 lines in repeated intervals of 4T (the horizontal bars 51).

At the time when the printing of the 76th line is performed, the CPU 11 specifies the respective numbers of the ON dots for 36 lines. The lines for which the numbers of the ON dots are specified include the 112th line, where the printing of the line segment 62 will be performed. Therefore, the number of the ON dots X when the printing of the line segment 62 is performed at the 112th line is specified as the maximum value. The target feed speed that corresponds to the number of the ON dots X is 4.

The feed speed at the time when the printing of the 76th line is performed is 8, so it will be necessary to reduce the feed speed from 8 to 4. In the second table 142 (refer to FIG. 10), the provisional feed speed of 7 is associated with the target feed speed of 4 and the feed speed of 8 at the time when the numbers of the ON dots are specified. The CPU 11 sets the four control pulses for changing the feed speed from 8 to 7 within the time period 4T. Starting from the time when the printing of the next line, the 77th line, is performed, the CPU 11 sequentially transmits the set control pulses to the drive motor 18, transmitting one control pulse in each of the cycles T (for the 77th to the 80th lines). The feed speed is thus reduced from 8 to 7.

Next, the CPU 11 specifies the numbers of the ON dots at the time when the printing of the 80th line is performed. At this time, the feed speed has been changed to 7. Referring to the first table 141, the CPU 11 specifies 32 as the number of lines that corresponds to the feed speed of 7. The CPU 11 specifies the respective numbers of the ON dots for 32 lines. The lines for which the numbers of the ON dots are specified include the 112th line, where the printing of the line segment 62 is performed, so the number of the ON dots X is specified as the maximum value. Therefore, the CPU 11 once again specifies 4 as the target feed speed.

The feed speed at the time when the printing of the 80th line is performed is 7, so it will be necessary to reduce the feed speed from 7 to 4. In the second table 142, the provisional feed speed of 6 is associated with the target feed speed of 4 and the feed speed of 7 at the time when the numbers of the ON dots are specified. The CPU 11 sets the four control pulses for changing the feed speed from 7 to 6 within the time period 4T. Starting from the time when the printing of the next line, the 81st line, is performed, the CPU 11 sequentially transmits the set control pulses to the drive motor 18, transmitting one control pulse in each of the cycles T (for the 81st to the 84th lines). The feed speed is thus reduced from 7 to 6.

The CPU 11 repeats the same sort of processing until the feed speed becomes 4 (from the 77th to the 92nd lines). The feed speed gradually becomes slower, so the corresponding numbers of lines gradually become less (the horizontal bars 52). The feed speed becomes 4 at the time when the printing of the 92nd line is performed (the descending line segment 41). The number of lines that corresponds to the feed speed of 4 is 20 (the horizontal bar 53). The point when the feed speed becomes 4 comes a little sooner than it does in the descending line segment 91 in the case where the feed speed is controlled by the known method described above. The reason for this is that, in the present embodiment, the number of lines (36 lines) that corresponds to the feed speed of 8 at the time when the numbers of the ON dots are specified is slightly larger than the number of lines (32 lines) in the case of the known control method.

After the feed speed has reached the target feed speed of 4, the CPU 11 maintains the feed speed at 4 for as long as the 112th line is included in the lines for which the numbers of the ON dots are specified. During the time while the printing of the 96th to the 112th is being performed, the CPU 11 specifies the respective numbers of the ON dots for 20 lines in repeated intervals of 4T (the horizontal bars 54).

At the time when the printing of the 112th line is performed, the CPU 11 specifies the respective numbers of the ON dots for 20 lines. The printing of the line segment 62 is already performed, so the 112th line is not included in the lines for which the numbers of the ON dots are specified. Only the line segment 61 will be printed, so the maximum value among the numbers of the ON dots becomes smaller. The CPU 11 thus sets the target feed speed to 8. In the second table 142, the provisional feed speed of 5 is associated with the target feed speed of 8 and the feed speed of 4 at the time when the numbers of the ON dots are specified. The CPU 11 sets the four control pulses for changing the feed speed from 4 to 5 within the time period 4T. Starting from the time when the printing of the next line, the 113th line, is performed, the CPU 11 sequentially transmits the set control pulses to the drive motor 18, transmitting one control pulse in each of the cycles T (for the 113th to the 116th lines). The feed speed is thus increased from 4 to 5.

Next, the CPU 11 specifies the numbers of the ON dots at the time when the printing of the 116th line is performed. At this time, the feed speed has been changed to 5. Referring to the first table 141, the CPU 11 specifies 24 as the number of lines that corresponds to the feed speed of 5. The CPU 11 specifies the respective numbers of the ON dots for 24 lines. Within the lines for which the numbers of the ON dots are specified, only the printing of the line segment 61 is performed, so the maximum value among the numbers of the ON dots is low. Therefore, the CPU 11 once again specifies 8 as the target feed speed.

The feed speed at the time when the printing of the 116th line is performed is 5, so it will be necessary to increase the feed speed from 5 to 8. In the second table 142, the provisional feed speed of 6 is associated with the target feed speed of 8 and the feed speed of 5 at the time when the numbers of the ON dots are specified. The CPU 11 sets the four control pulses for changing the feed speed from 5 to 6 within the time period 4T. Starting from the time when the printing of the next line, the 117th line, is performed, the CPU 11 sequentially transmits the set control pulses to the drive motor 18, transmitting one control pulse in each of the cycles T (for the 117th to the 120th lines). The feed speed is thus increased from 5 to 6.

The CPU 11 repeats the same sort of processing until the feed speed becomes 8 (from the 113th to the 128th lines). The feed speed gradually becomes faster, so the corresponding numbers of lines gradually become greater (the horizontal bars 55). The feed speed becomes 8 at the time when the printing of the 128th line is performed (the ascending line segment 42). The number of lines that corresponds to the feed speed of 8 is 36.

The points of difference between the known method and the method according to the present embodiment in the changing of the feed speed during the processing that has been described above will now be described. With the method according to the present embodiment, the feed speed increases from 4 to 8 during the time when the 112th to the 128th lines are being printed (the ascending line segment 42). In contrast, with the known method, the feed speed is maintained at 4 (the horizontal line segment 92). Increasing the feed speed as is done in the present embodiment causes the heat-sensitive tape 8 to be fed more quickly. Therefore, the time that is required in order to complete the printing of all of the lines can be shortened. Thus, according to the present embodiment, because the CPU 11 makes the intervals at which the numbers of the ON dots are specified shorter than they are with the known method, and varies the number of lines for which the numbers of the ON dots are specified, it is possible to complete the printing of all of the lines in a shorter time.

At the time when the printing of the 140th line is performed, the CPU 11 specifies the respective numbers of the ON dots for 36 lines. The lines for which the numbers of the ON dots are specified include the 176th line, where the printing of the line segment 63 will be performed. Therefore, the number of the ON dots 2X when the printing of the line segment 63 is performed at the 176th line is specified as the maximum value. The target feed speed that corresponds to the number of the ON dots 2X is zero.

The feed speed at the time when the printing of the 140th line is performed is 8, so it will be necessary to reduce the feed speed from 8 to zero. In the second table 142, the provisional feed speed of 7 is associated with the target feed speed of zero and the feed speed of 8 at the time when the numbers of the ON dots are specified. The CPU 11 sets the four control pulses for changing the feed speed from 8 to 7 within the time period 4T. Starting from the time when the printing of the next line, the 141st line, is performed, the CPU 11 sequentially transmits the set control pulses to the drive motor 18, transmitting one control pulse in each of the cycles T (for the 141st to the 144th lines). The feed speed is thus reduced from 8 to 7. The CPU 11 repeats the same sort of processing (from the 141st to the 172nd lines) until the feed speed becomes zero. The feed speed gradually becomes slower, so the corresponding numbers of lines gradually become less (the horizontal bars 56). The feed speed becomes zero at the time when the printing of the 172nd line is performed (the descending line segment 43). The number of lines that corresponds to the feed speed of zero is 4 (the horizontal bar 57).

The points of difference between the known method and the method according to the present embodiment in the changing of the feed speed during the processing that has been described above will now be described. With the known method, the feed speed changes such that it finally becomes zero at the time when the printing of the 160th line is performed (the descending line segment 93; refer to FIG. 6). In contrast to this, with the method according to the present embodiment, the feed speed changes such that it finally becomes zero at the time when the printing of the 172nd line is performed (the descending line segment 43). Thus, in the present embodiment, the CPU 11 is able to control the feed speed such that the feed speed becomes zero immediately before the line segment 63 is printed at the 176th line. Therefore, the printer 1 is able to feed the heat-sensitive tape 8 at a faster feed speed than it can when using the known method. Thus, according to the present embodiment, because the CPU 11 makes the intervals at which the numbers of the ON dots are specified shorter than they are with the known method, and varies the number of lines for which the numbers of the ON dots are specified, it is possible to optimize the conformity of the feed speed to the changes in the number of the ON dots.

At the time when the printing of the 176th line is performed, the CPU 11 specifies the respective numbers of the ON dots for 4 lines. The printing of the line segment 63 is already performed, so the 176th line is not included in the lines for which the numbers of the ON dots are specified. Only the line segment 61 will be printed, so the maximum value among the numbers of the ON dots becomes smaller. The CPU 11 sets the target feed speed to 8. The performing by the CPU 11 of the same sort of processing as that described above (from the 176th to the 208th lines) will bring the feed speed to 8. The feed speed gradually becomes faster, so the corresponding numbers of lines gradually become greater (the horizontal bars 58). The feed speed becomes 8 at the time when the printing of the 208th line is performed (the ascending line segment 44). The number of lines that corresponds to the feed speed of 8 is 36.

The points of difference between the known method and the method according to the present embodiment in the changing of the feed speed during the processing that has been described above will now be described. With the known method, the feed speed changes such that it finally becomes 8 at the time when the printing of the 224th line is performed (the ascending line segment 94; refer to FIG. 6). In contrast to this, with the method according to the present embodiment, the feed speed changes such that it finally becomes 8 at the time when the printing of the 208th line is performed (the ascending line segment 44). Thus, in the present embodiment, the CPU 11 is able to perform control that increases the feed speed immediately after the line segment 63 is printed at the 176th line. Therefore, the heat-sensitive tape 8 can be fed at a faster feed speed than it can when the known method is used. Thus, according to the present embodiment, because the CPU 11 makes the intervals at which the numbers of the ON dots are specified shorter than they are with the known method, and varies the number of lines for which the numbers of the ON dots are specified, it is possible to optimize the conformity of the feed speed to the changes in the number of the ON dots.

The processing (main processing) in a case where the CPU 11 performs the control according to the method in the present embodiment that has been described above will be explained in specific terms with reference to FIGS. 12 and 13. Hereinafter, for the parts of the processing that are the same as the main processing according to the known method, which was explained with reference to FIGS. 7 and 8, the same reference numerals are used, and the explanations will be simplified. The CPU 11 functions as an example of a processor that performs the main processing by loading into the SRAM 12 the program that has been stored in the flash ROM 13. Note that, in the printer 1, a microcomputer, an application-specific integrated circuit (ASIC), a field-programmable gate array (FPGA), or the like may be used as the processor instead of the CPU 11.

Figure 12:
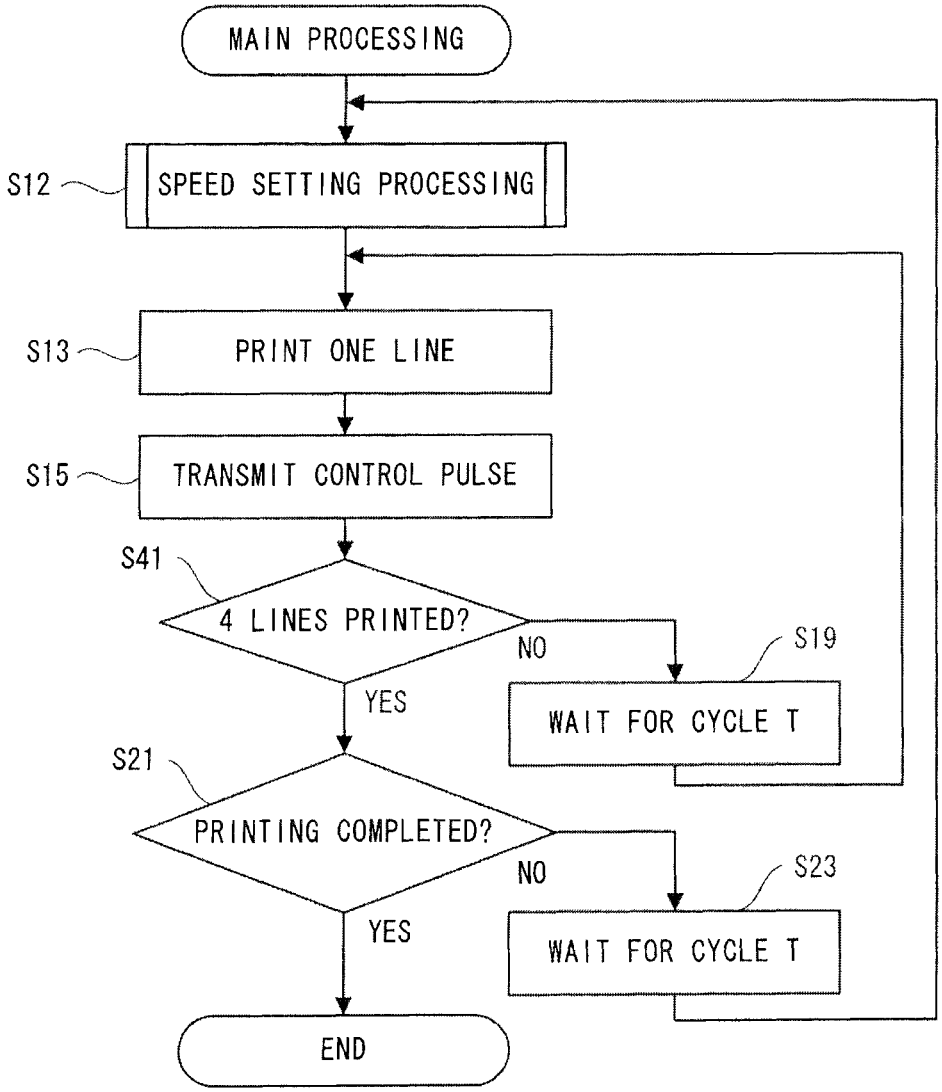
FIG. 12 is a flowchart of main processing in the embodiment.
Figure 13:
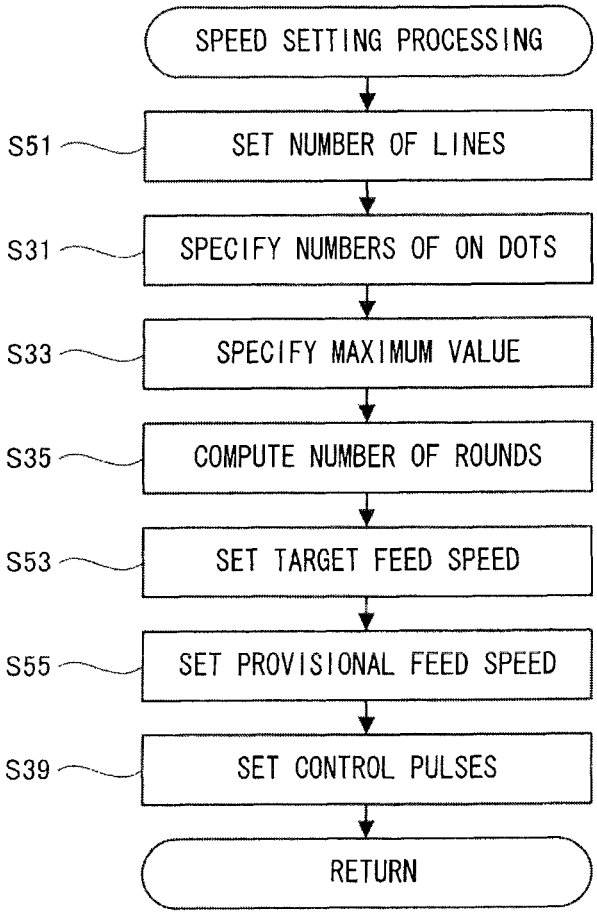
FIG. 13 is a flowchart of speed setting processing in the embodiment.

As shown in FIG. 12, the CPU 11 first performs processing (speed setting processing; refer to FIG. 13) that sets the target feed speed based on the numbers of the ON dots (Step S12). As shown in FIG. 13, the CPU 11 first sets the number of lines for which the numbers of the ON dots will be specified (Step S51). The CPU 11 sets the number of lines by using the feed speed at the current time, that is, at the time that the number of lines is set, to look up the number of lines in the first table 141 (refer to FIG. 9). Based on the printing data, the CPU 11 specifies the respective numbers of the ON dots for the number of lines that has been set (Step S31). The CPU 11 specifies the maximum value among the specified numbers of the ON dots for the specified number of lines (Step S33). The CPU 11 computes the number of rounds of operation by dividing the maximum value among the specified numbers of the ON dots by the number of the heating elements that can be operated at the same time (Step S35).

Based on the number of rounds of operation it has computed, the CPU 11 sets the optimum target feed speed to one of the nine levels (Step S53). For example, the CPU 11 may set the target feed speed by referring to a table that is stored in advance in the flash ROM 13 and that defines correspondence relationships between the numbers of rounds and the target feed speeds, although this is not shown in the drawings. The CPU 11 sets the provisional feed speed (Step S55) by using the feed speed at the current time and the target feed speed it has set to look up the provisional feed speed in the second table 142 (refer to FIG. 10). Based on the provisional feed speed it has set, the CPU 11 sets the 4 control pulses for operating the drive motor 18 (Step S39). The CPU 11 terminates the speed setting processing and returns to the main processing (refer to FIG. 12).

As shown in FIG. 12, after the speed setting processing (Step S11) is terminated, the CPU 11 performs the printing of one line (Step S13). The CPU 11 sequentially transmits the control pulses that were set at Step S39 (refer to FIG. 13) to the drive motor 18 (Step S15). The CPU 11 thus controls the revolution speed of the drive motor 18. The CPU 11 determines whether the printing of 4 lines has been completed (Step S41). In a case where the printing of 4 lines has not been completed (NO at Step S41), the CPU 11 waits for one cycle T (Step S19) and returns to the processing at Step S13.

In a case where the printing of 4 lines has been completed (YES at Step S41), the CPU 11 determines whether the printing of all of the lines has been completed (Step S21). In a case where the printing of all of the lines has not been completed (NO at Step S21), the CPU 11 waits for one cycle T (Step S23) and returns to the processing at Step S12. In a case where the printing of all of the lines has been completed (YES at Step S21), the CPU 11 terminates the main processing.

As explained above, by setting the number of lines for which the numbers of the ON dots are specified based on the feed speed, the printer 1 according to the present embodiment is able to reduce the number of lines as necessary. The printer 1 is thus able to optimize the timing at which the feed speed is changed and is able to maintain a state in which the feed speed is as fast as possible. The printer 1 is therefore able to shorten the time that is required in order to complete the printing of all of the lines. The printer 1 is also able, as necessary, to increase the number of lines for which the numbers of the ON dots are specified. Thus, by specifying the numbers of the ON dots for the lines farther in advance, the printer 1 is able to ensure sufficient time for changing the feed speed to the target feed speed. Therefore, by changing the feed speed appropriately, the printer 1 is able to improve the dependability of the printing processing.

Note that the embodiment that has been described above is only an example, and various types of modifications can be made. For example, parameters such as the range of the number of lines for which the numbers of the ON dots are specified (4 to 36 lines), the interval (4T) at which the numbers of the ON dots are specified, and the like may be changed to other values. The printing medium is not limited to the heat-sensitive tape 8, and it may also be heat-sensitive paper or the like. In the embodiment that is described above, the CPU 11 specifies the target feed speed according to the number of rounds of operation that is computed based on the number of the ON dots. The CPU 11 may also specify the target feed speed based on the number of the ON dots itself, not on the number of rounds of operation. For example, the flash ROM 13 may also store a table in which the numbers of the ON dots and the target feed speeds are associated with one another. By referring to the table, the CPU 11 may then specify the target feed speed that corresponds to the number of the ON dots. In the embodiment that is described above, the CPU 11 sets the control pulses that control the drive motor 18 in units of 4 pulses. However, the number of the control pulses that the CPU 11 sets at one time may also be greater than 4. For example, the CPU 11 may also specify, all at once, all of the control pulses that will be necessary in order to change the feed speed to the target feed speed, and then sequentially transmit the control pulses to the drive motor 18 at specified intervals.

the CPU 11 may also set the provisional feed speed and the control pulses that will be transmitted to the drive motor 18 in order to change the feed speed to the provisional feed speed, based on a third table 143, an example of which is shown in FIG. 14. This will now be described in detail. The third table 143 may be stored in the flash ROM 13, for example, in advance. The feed speeds at the times when the numbers of the ON dots are specified, the target feed speeds, the provisional feed speeds, and the control pulses may be stored in association with one another in the third table 143. The CPU 11 may set the target feed speed based on the maximum value among the specified numbers of the ON dots (Step S53; refer to FIG. 13). The CPU 11 may set the provisional feed speed by referring to the third table 143 instead of to the second table 142 (refer to FIG. 10) (Step S55). The CPU 11 may set the control pulses for controlling the revolution speed of the drive motor 18 by referring to the 4 control pulses that are associated with the provisional feed speed that has been set (Step S39). By using the third table 143 in this manner, the CPU 11 can easily set the provisional feed speed and the control pulses.

The apparatus and methods described above with reference to the various embodiments are merely examples. It goes without saying that they are not confined to the depicted embodiments. While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. A printer, comprising:

a feeding portion that is configured to feed a printing medium in an auxiliary scanning direction;

a printing portion that includes a plurality of heating elements arrayed in a main scanning direction, the main scanning direction being orthogonal to the auxiliary scanning direction, the heating elements being configured to perform printing of one line at a time on the printing medium fed by the feeding portion in the auxiliary scanning direction, the one line extending in the main scanning direction; and a processor that is configured to set, based on a relationship between a first speed and a minimum feed speed, a number of lines for each of which a number of ON dots is specified, among a plurality of lines that make up a printed pattern, the number of ON dots being a number of heating elements, among the plurality of heating elements, that are to be operated when the printing of one line is performed, the first speed being a feed speed of the printing medium fed by the feeding portion, the minimum feed speed being a slowest feed speed at which the feeding portion is able to feed the printing medium, and the number of lines being set to a greater number as a difference between the first speed and the minimum feed speed becomes greater;

specify numbers of ON dots for the set number of lines, set a second speed based on a maximum value among the specified numbers of ON dots, the second speed being a target feed speed in a case where the feed speed is changed from the first speed, control the feeding portion such that the feed speed is changed from the first speed to the second speed, and control the printing portion such that the printing is performed sequentially one line at a time.

2. The printer according to claim 1, wherein the processor is further configured to set the second speed to a slower speed as the maximum value among the specified numbers of ON dots becomes greater.

3. The printer according to claim 1, further comprising:

a storage portion that is configured to store a table in which information relating to the first speed, information relating to the second speed, and information relating to an amount of operation of a drive source of the feeding portion are associated with one another, wherein the processor is further configured to specify, by referring to the table stored in the storage portion, the amount of operation associated with the first speed and the second speed, and control the feeding portion based on the specified amount of operation.

4. A non-transitory computer-readable medium that stores computer-readable instructions, wherein the computer-readable instructions, when executed, cause a printer to perform the steps of:

setting, based on a relationship between a first speed and a minimum feed speed, a number of lines for each of which a number of ON dots is specified, among a plurality of lines that make up a printed pattern, the number of the ON dots being a number of heating elements, among a plurality of heating elements of a printing portion of the printer, that are to be operated when the printing of one line is performed, the first speed being a feed speed of a printing medium fed by a feeding portion of the printer, the minimum feed speed being a slowest feed speed at which the feeding portion is able to feed the printing medium, the number of lines being set to a greater number as a difference between the first speed and the minimum feed speed becomes greater, the feeding portion being configured to feed the printing medium in an auxiliary scanning direction, the plurality of heating elements being arrayed in a main scanning direction and being configured to perform printing of one line at a time on the printing medium fed by the feeding portion in the auxiliary scanning direction, the main scanning direction being orthogonal to the auxiliary scanning direction, and the one line extending in the main scanning direction, specifying numbers of ON dots for the set number of lines;

setting a second speed based on a maximum value among the specified numbers of ON dots, the second speed being a target feed speed in a case where the feed speed is changed from the first speed;

controlling the feeding portion such that the feed speed is changed from the first speed to the second speed; and controlling the printing portion such that the printing is performed sequentially one line at a time.

5. The non-transitory computer-readable medium according to claim 4, wherein the setting of the second speed includes setting the second speed to a slower speed as the maximum value among the specified numbers of ON dots becomes greater.

6. The non-transitory computer-readable medium according to claim 4, wherein the computer-readable instructions further cause the printer to perform the steps of: specifying, by referring to a table stored in a storage portion, an amount of operation of a drive source of the feeding portion associated with the first speed and the second speed, the table being a table in which information relating to the first speed, information relating to the second speed, and information relating to the amount of operation are associated with one another, and controlling the feeding portion based on the specified amount of operation.

* * * * *